US007334767B2

(12) United States Patent
Wright

(10) Patent No.: US 7,334,767 B2
(45) Date of Patent: Feb. 26, 2008

(54) TOOL-LESS FRAME FASTENING SYSTEM

(76) Inventor: Doug S. Wright, 3554 Quincy Ave., Simi Valley, CA (US) 93063

( * ) Notice: Subject to any disclaimer, the term of this patent is extended or adjusted under 35 U.S.C. 154(b) by 125 days.

(21) Appl. No.: 10/871,112

(22) Filed: Jun. 18, 2004

(65) Prior Publication Data

US 2005/0072891 A1 Apr. 7, 2005

Related U.S. Application Data

(60) Provisional application No. 60/497,752, filed on Aug. 26, 2003.

(51) Int. Cl.
*B42F 13/00* (2006.01)

(52) U.S. Cl. ..... 248/342; 381/386; 411/418

(58) Field of Classification Search ..... 248/342, 248/343, 344; 411/417, 418, 114, 205; 381/386, 381/387, 395; 403/128, 90, 109.1, 109.2, 403/109.3, 109.8, 122, 137, 141, 142, 148, 403/329; 362/364, 365, 366, 370, 371, 372, 362/374, 421, 147, 148
See application file for complete search history.

(56) References Cited

U.S. PATENT DOCUMENTS 4,993,510 A * 2/1991 Kato et al. ..... 181/141
5,143,339 A 9/1992 Ashcraft et al.
D340,718 S 10/1993 Leger et al.
5,734,732 A 3/1998 Lemmon
5,867,583 A 2/1999 Hazelwood et al.
5,952,619 A 9/1999 Kantor et al.
5,980,177 A * 11/1999 Schiess et al. ..... 411/299
D419,561 S 1/2000 Haase et al.
6,026,927 A 2/2000 Burdett et al.
6,070,694 A 6/2000 Burdett et al.
6,101,262 A 8/2000 Haase et al.
6,375,142 B1 4/2002 Miller et al.
D461,464 S 8/2002 Sterns et al.
6,456,722 B1 * 9/2002 Davey et al. ..... 381/389
D475,364 S 6/2003 Sterns et al.
6,683,963 B2 1/2004 Sterns et al.

* cited by examiner

*Primary Examiner*—Korie Chan
(74) *Attorney, Agent, or Firm*—Loza & Loza LLP; Julio M. Loza

(57) ABSTRACT

A frame assembly for mounting recessed fixtures that can be manually installed without the use of tools. One embodiment of the invention includes a primary mounting frame for recessed installation, the primary mounting frame defining an open interior to accommodate a fixture and including a border flange along the outer edge of the open interior. A ratcheting fastener is rotationally coupled to the primary mounting frame and can be manually secured by depressing it toward the border flange to secure the primary mounting frame between opposite surfaces of a substrate. The ratcheting fastener can be rotated to engaged or disengaged from ratcheting teeth.

18 Claims, 22 Drawing Sheets

TOOL-LESS FRAME FASTENING SYSTEM

CROSS REFERENCE TO RELATED APPLICATIONS

This non-provisional United States (U.S.) patent application claims the benefit of provisional U.S. Patent Application No. 60/497,752, filed Aug. 26, 2003; and is related to U.S. patent application Ser. No. 10/871,069 filed on Jun. 18, 2004 by inventor Doug S. Wright, titled "Snap-In and Lock Baffle", and is also related to U.S. patent application Ser. No. 10/871,111 filed on Jun. 18, 2004 by inventor Doug S. Wright, titled "Angled Speaker Assembly."

FIELD

Various embodiments of the invention pertain to mounting assemblies. More particularly, at least one embodiment of the invention relates to a device, system, and method for efficiently mounting a speaker frame assembly within a wall or ceiling recess.

DESCRIPTION OF RELATED ART

Speakers, vents, exhaust fans are often mounted within a wall or ceiling cavity or recess. A frame assembly is commonly used to secure the speakers, vents, and/or exhaust fans to the wall or ceiling. Various types of frames and fasteners are used for the purpose of securing the frames to the wall or ceiling cavities.

Some conventional mounting systems are pressure fitted into the ceiling or wall cavity. However, this type of mounting system is undesirable because it does not provide a safe or strong way of securing devices such as speakers and exhaust fans. Other conventional fastening methods require the use of tools to turn a fastening screw. This is cumbersome and inconvenient in many cases. For example, when installing a recessed speaker within a ceiling cavity the installer would have to hold the frame in place with one hand while trying to turn a screw to secure the frame in place. Moreover, conventional frame fastening systems are not easy to remove and/or replace when maintenance may be required.

Consequently, conventional mounting systems and fasteners are typically cumbersome and time-consuming to install, take many steps to mount, and require the use of several tools. This increases the cost of installation and deployment of, for instance, recessed speakers, lights, or exhaust fans.

SUMMARY

One embodiment of the invention relates to a speaker mounting assembly having a primary mounting frame for recessed installation. The primary mounting frame defines an open interior to accommodate a fixture and includes a border flange along the outer edge of the open interior. A ratcheting fastener is rotationally coupled to the primary mounting frame to manually secure the mounting assembly in a ceiling or wall cavity. The ratcheting fastener is tightened by manually depressing it toward the border flange to secure the primary mounting frame between opposite surfaces of a mounting substrate. A retaining frame is coupled to the primary frame at an opposite end than the border flange to retain the ratcheting fastener between the primary mounting frame and the retaining frame.

According to one embodiment of the invention, the ratcheting fastener includes a ratchet post having a first longitudinal portion that has a plurality of substantially parallel teeth and a second longitudinal portion that is substantially smooth. The ratcheting fastener also includes a retainer having a sleeve defining a passage through which the ratchet post passes and one or more fingers flexibly protruding into the passage through which the ratchet post passes. The one or more fingers engage the substantially parallel teeth on the first longitudinal portion of the ratchet post when the ratchet post is in a first position, and slides over the substantially smooth portion on the second longitudinal portion of the ratchet post when the ratchet post is in a second position. The ratcheting fastener is released by rotating the retainer to disengage the one or more fingers from the teeth on the first longitudinal portion of the ratchet post, manually rotating the ratcheting fastener and sliding it away from the border flange to release the primary mounting frame. The ratcheting fastener is released by rotating the ratchet post to disengage the teeth on the first longitudinal portion from the one or more fingers on the retainer.

DETAILED DESCRIPTION

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

In the following description, certain terminology is used to describe certain features of one or more embodiments of the invention. For instance, "fastener" and "retainer" are interchangeably used to refer to any type of securing mechanism. The term "speaker" is used to refer to any type of sound-generating device such as audio electronic equipment, loudspeakers, audio speakers, woofers, subwoofers, audio mixers, tweeters, and acoustic transducers. The term "manually" refers to a motion or task performed by hand and without the aid of a tool.

One aspect of the invention provides a frame assembly for mounting fixtures within a recess in a wall or ceiling and can be installed with minimal time and effort.

Another aspect of the invention provides a fastener that can be manually installed and secured without the use of tools.

Figure 1:
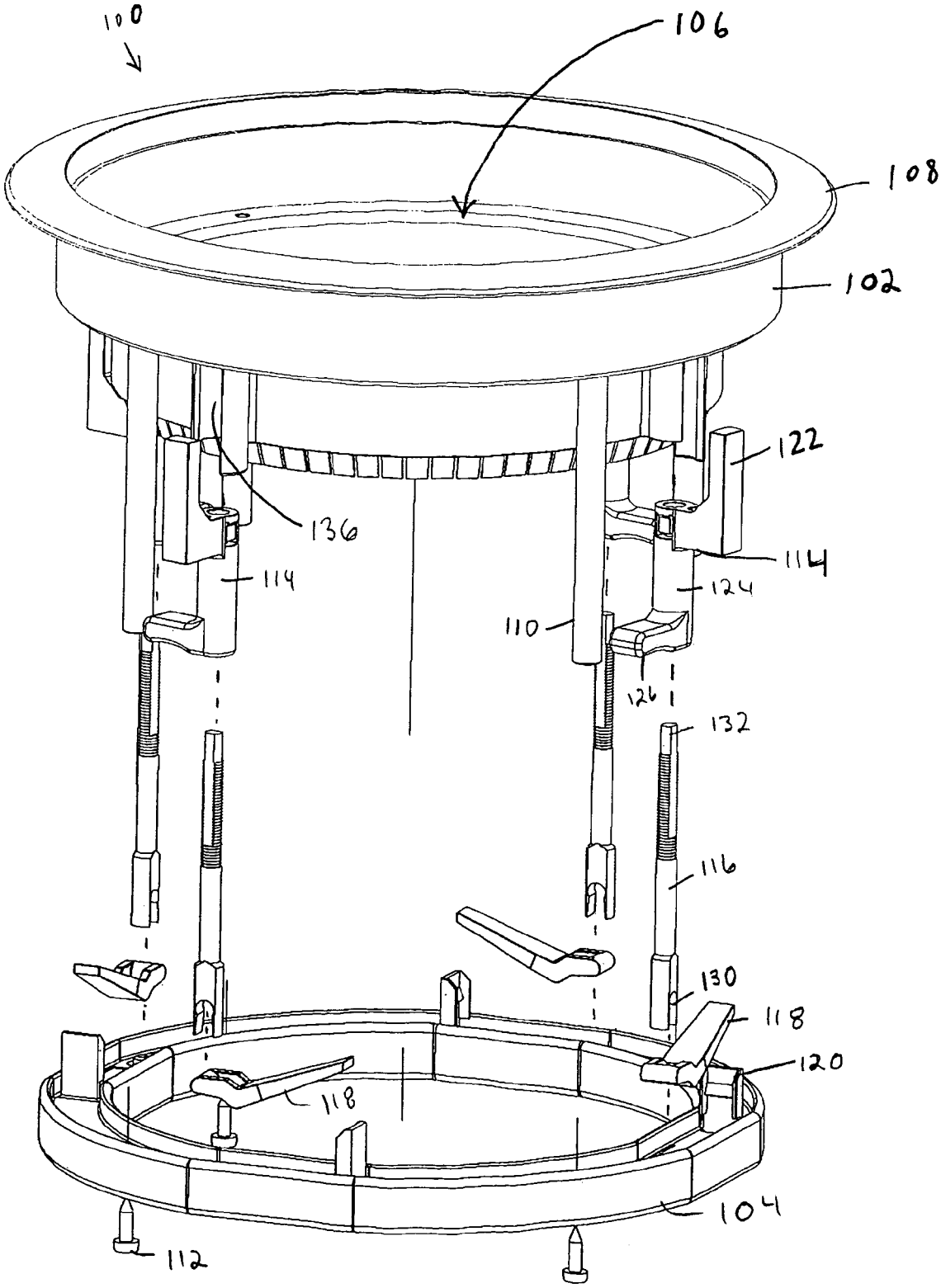
FIG. 1 illustrates an exploded side-view of a frame assembly fastening system according to one embodiment of the invention.

FIG. 1 illustrates an exploded view of a frame assembly fastening system according to one embodiment of the invention. This frame assembly and fastening system 100 does not require the use of hand-tools or power-tools for its installation, aside from a saw to cut the receiving hole or recess in the wall or ceiling.

The frame assembly 100 includes a primary frame 102 and a retaining frame 104. According to one implementation, the primary frame assembly 102 is substantially circular and defines a cavity or opening 106 through which a speaker or other components may be mounted. The primary frame assembly 102 may include a border flange 108 which may serve as an external trim once the frame assembly 100 is mounted within a ceiling or wall recess. The primary frame 102 also includes a plurality of posts 110 on which the retaining frame 104 may be coupled by a pressure fit or one or more fasteners 112.

The frame assembly may also include a tool-less fastening system which includes a ratcheting retainer or fastener 114, a ratchet post 116, a latch 118, and a latch receiver 120. The ratcheting retainer 114 includes a retaining arm 122, a sleeve 124, and an adjusting arm 126. The sleeve 124 permits the ratchet post 116 to pass through the ratcheting retainer 114. One or more pins or wedges 128 serve to secure a threaded portion of the ratchet post 116 as discussed in more detail below. The latch 118 is movably coupled to a receiving end 130 of the ratchet post 116. When installed, the opposite end of the latch 118 is secured by the latch receiver 120. When the frame assembly 100 is constructed, the ratchet post 116 passes through the sleeve 124 of the ratcheting retainer 114, with a first end 132 of the ratchet post 116 fitting into a cavity in the primary frame 102 and a second end 130 fitting into a cavity in the retaining frame 104. The retaining frame 104 is coupled to one or more posts 110 to secure the tool-less fastening components 114, 116, 118 between the primary frame 102 and retaining frame 104.

Figure 2:
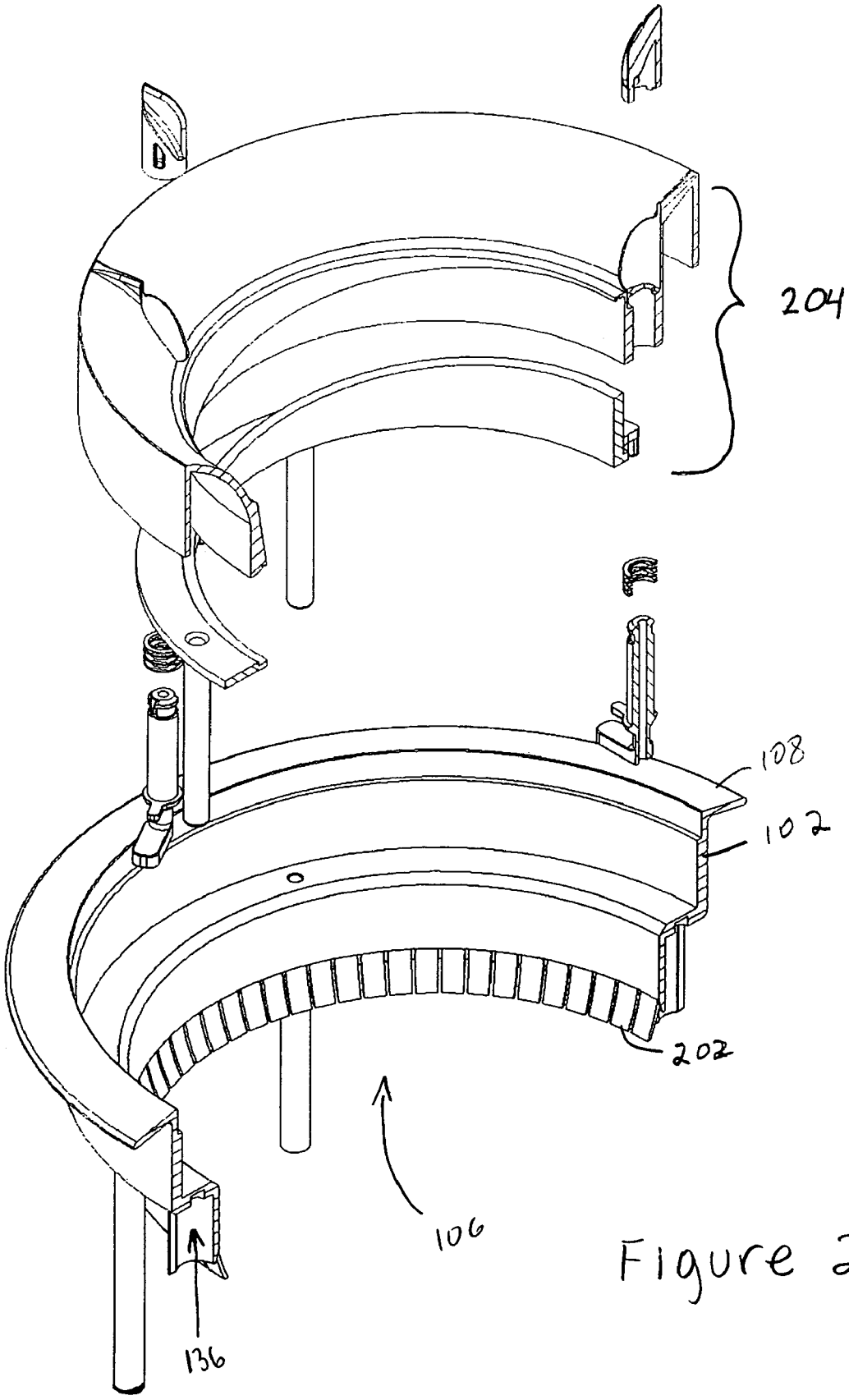
FIG. 2 illustrates a cross-sectional view of a frame assembly fastening system according to one embodiment of the invention.

FIG. 2 illustrates a cross-sectional view of a frame assembly fastening system according to one embodiment of the invention. The opening or cavity 106 through which a speaker or other components may be mounted is illustrated. Additionally, the primary frame 102 includes a plurality of flexible fingers 202 that help to align and secure a fixture housing 204, e.g., speaker, fan, light, etc., that may be inserted into the opening 106. The first end 132 of the ratchet post 116 (FIG. 1) is inserted into a cavity 136 in the primary frame 102.

Figure 3:
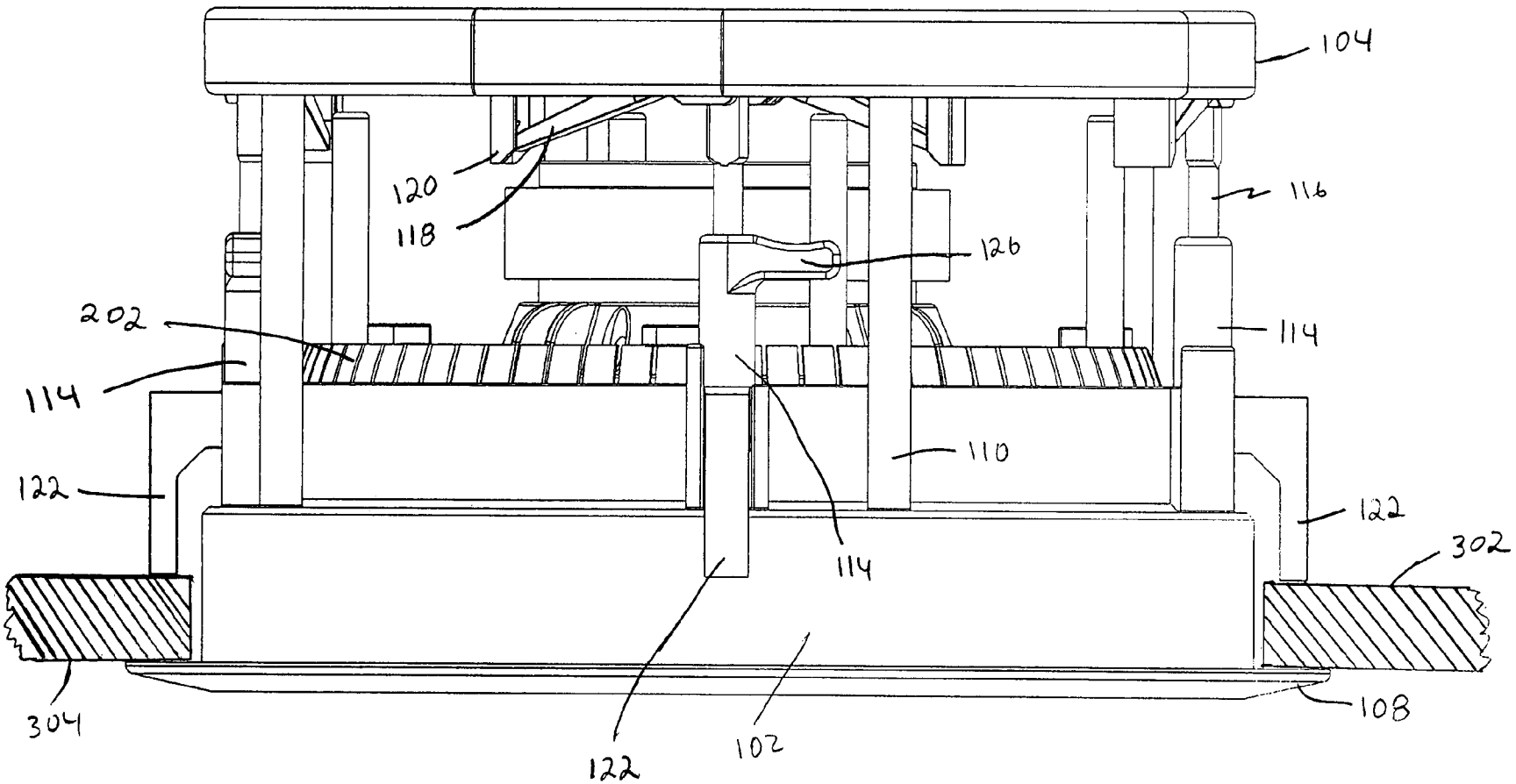
FIG. 3 illustrates how a frame assembly maybe inserted and secured in a wall or ceiling opening according to one embodiment of the invention.

FIG. 3 illustrates another cross-sectional view of how a frame assembly 100 maybe inserted into a wall or ceiling cavity according to one embodiment of the invention. In one implementation, a hole is cut into the ceiling or wall sheetrock 304. The hole is large enough so that the frame assembly 100 fits through it but small enough so that the border flange 108 is capable of covering gaps between the frame assembly 100 and the front surface 304 of the wall or ceiling 302.

The frame assembly 100 is inserted into the opening or recess with the ratcheting retainers 114 in a retracted position that permits the unobstructed insertion of the frame assembly 100 into the wall or ceiling opening. Once the frame assembly 100 is inserted in place, the installer can reach through the center opening 106 to manually rotate the ratcheting fastener 114 and slide it toward the border flange 108. This causes the retaining arm 122 to press against the back surface of the sheetrock or drywall, in the wall or ceiling, and secure the frame assembly 102 in place. A ratcheting mechanism, discussed below, maintains the ratcheting fastener 114 in place.

Figure 4:
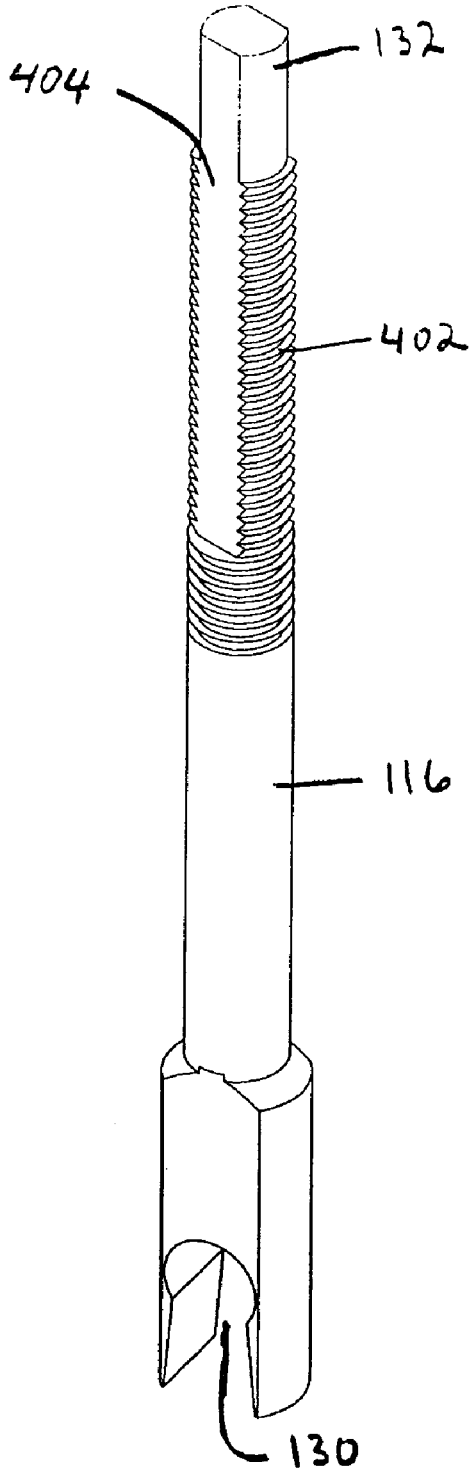
FIG. 4 illustrates a ratchet post according to one implementation of an embodiment of the invention.

FIG. 4 illustrates a ratchet post 116 according to one implementation of an embodiment of the invention. The ratchet post 116 includes an opening 130 into which one end of the latch 118 is inserted. The ratchet post 116 includes a first section of teeth or threads 402 along a first longitudinal portion of the post 116 and a substantially bare or smooth surface along a second longitudinal portion 404 of the post 116. In one implementation of the invention, the ratchet post 116 may have substantially symmetrical threaded sections 402 and symmetrical bare sections 404. When the frame assembly 100 is assembled, the first end 132 of the ratchet post 116 is inserted into a cavity in the primary frame 102.

Figure 5:
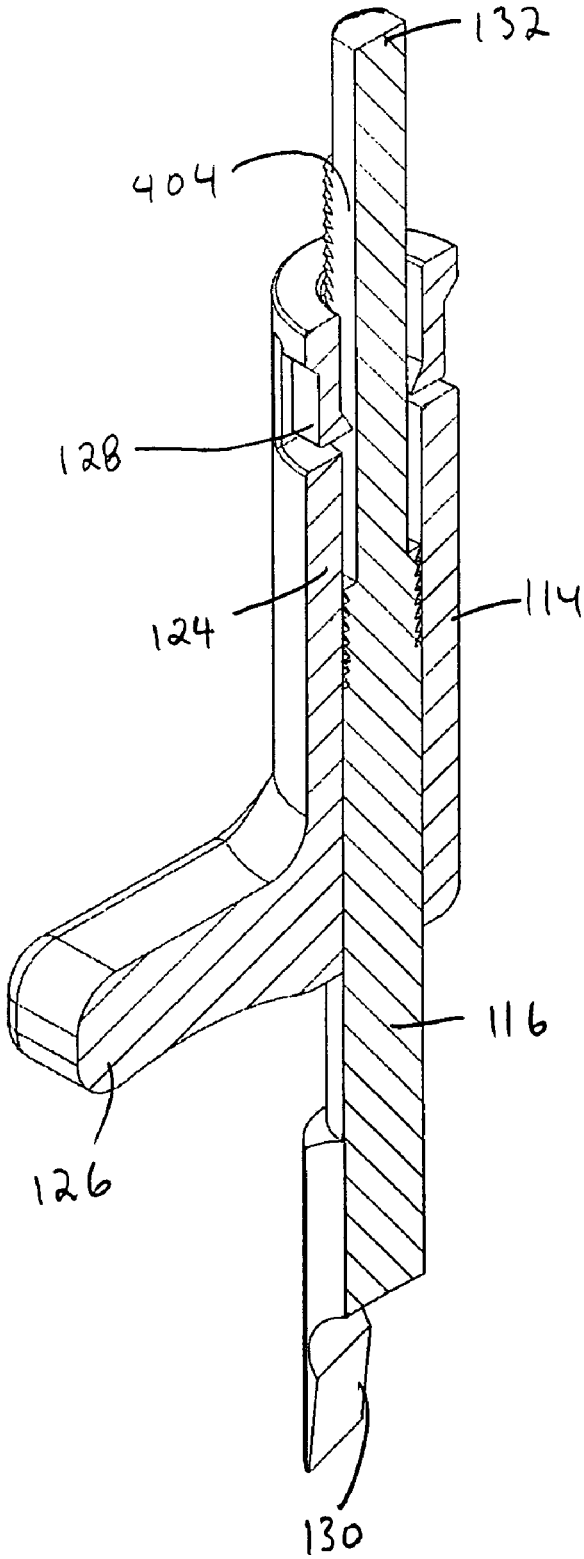
FIGS. 5-7 illustrate various views of the dog ratchet fastener in a disengaged position according to one embodiment of the invention.
Figure 6:
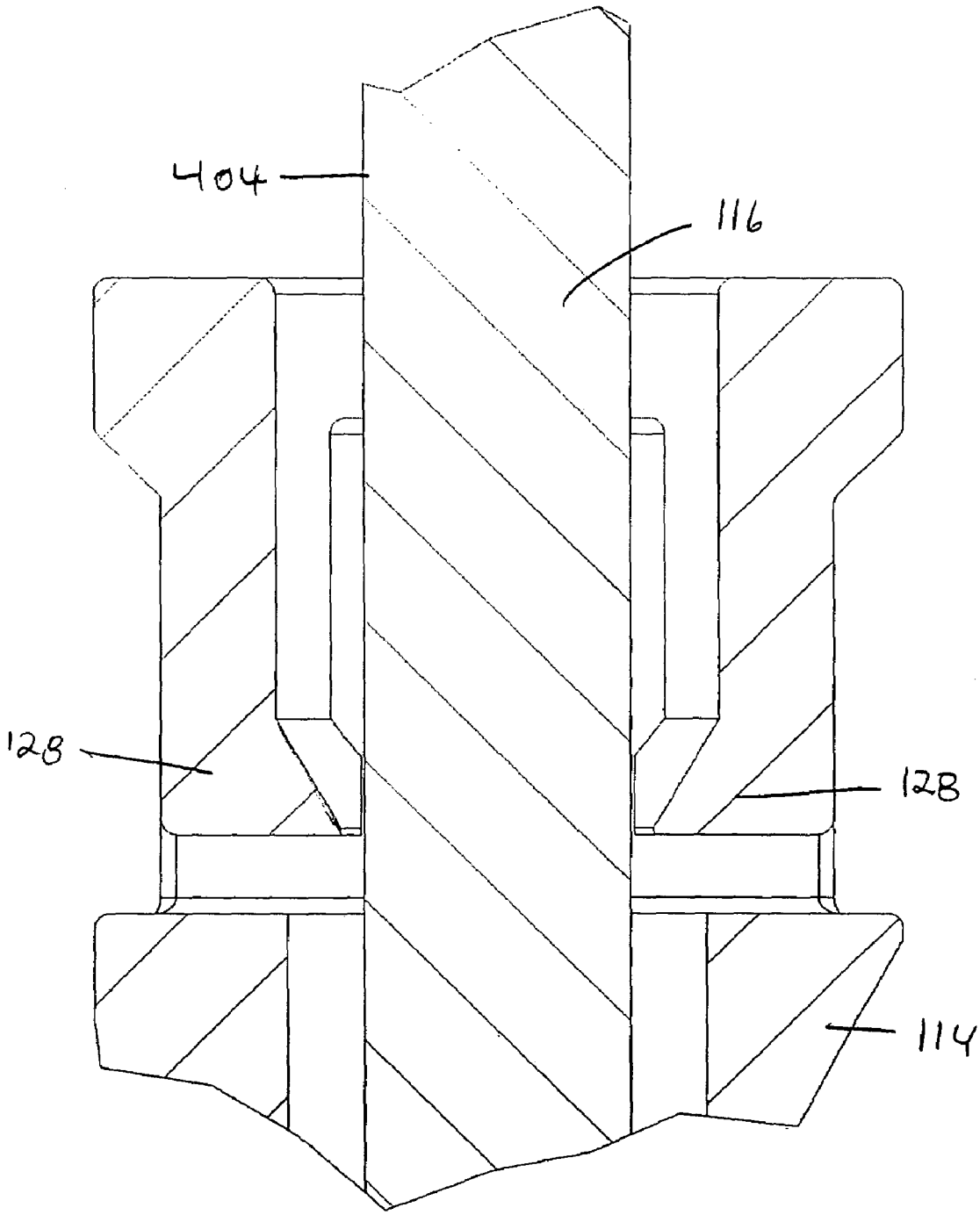
Figure 7:
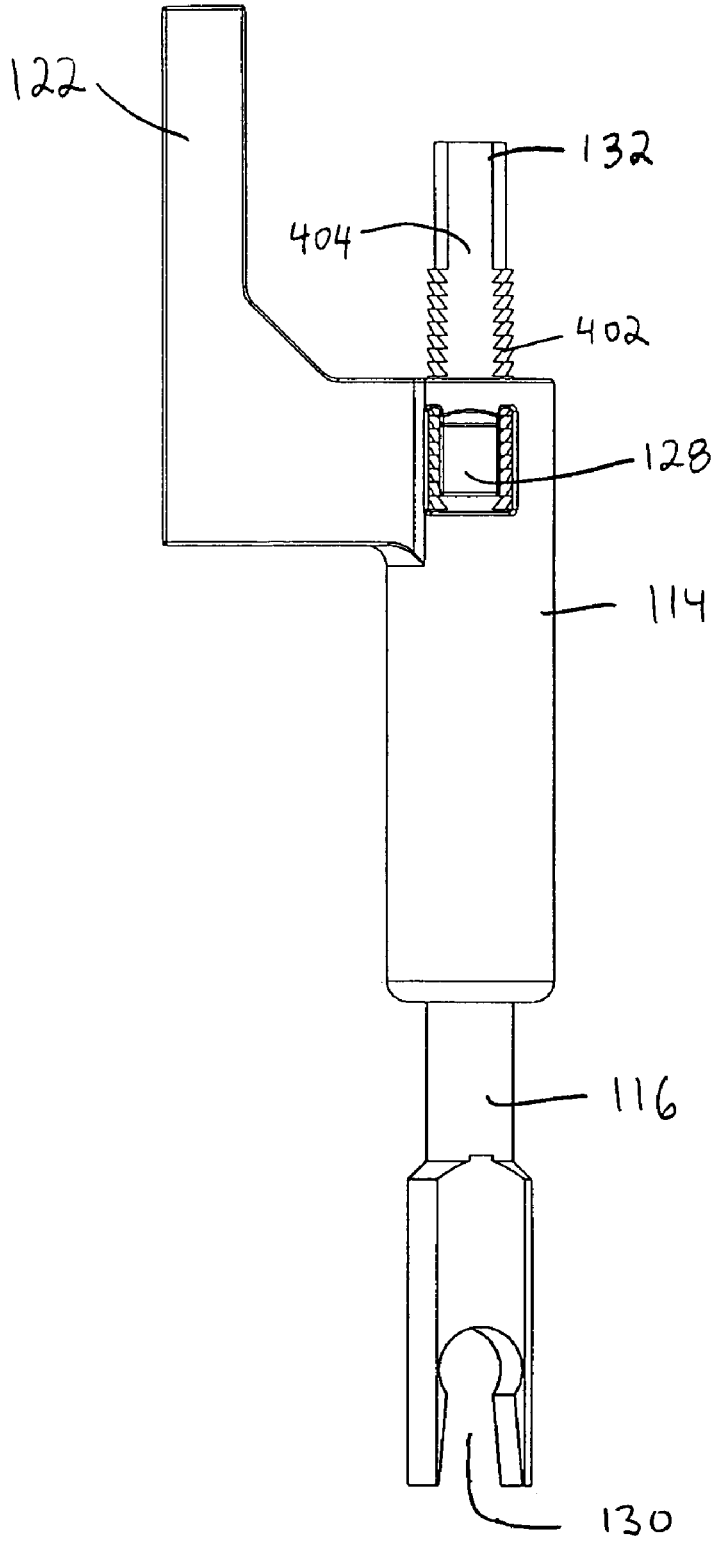

FIGS. 5-7 illustrate various views of the dog ratchet fastener in an disengaged position according to one embodiment of the invention. FIG. 5 illustrates a cross section of the ratcheting retainer 114 with the ratchet post 116 inserted through the sleeve 124. As illustrated in FIG. 4, the ratchet post 116 has a substantially smooth surface along the second longitudinal portion 404 that is inserted within the ratcheting retainer 114. The ratcheting retainer 114 also includes one or more retaining spring fingers 128.

FIGS. 5-7 illustrate that when the ratcheting retainer 114 is in a first position, the one or more fingers 128 rest against the substantially smooth second longitudinal portion 404 of the post 116 so that the ratcheting retainer 114 can move up or down along the ratchet post 116 without substantial restriction from the spring fingers 128. In this first position, the spring fingers 128 slide against the substantially smooth second longitudinal portion 404.

Figure 8:
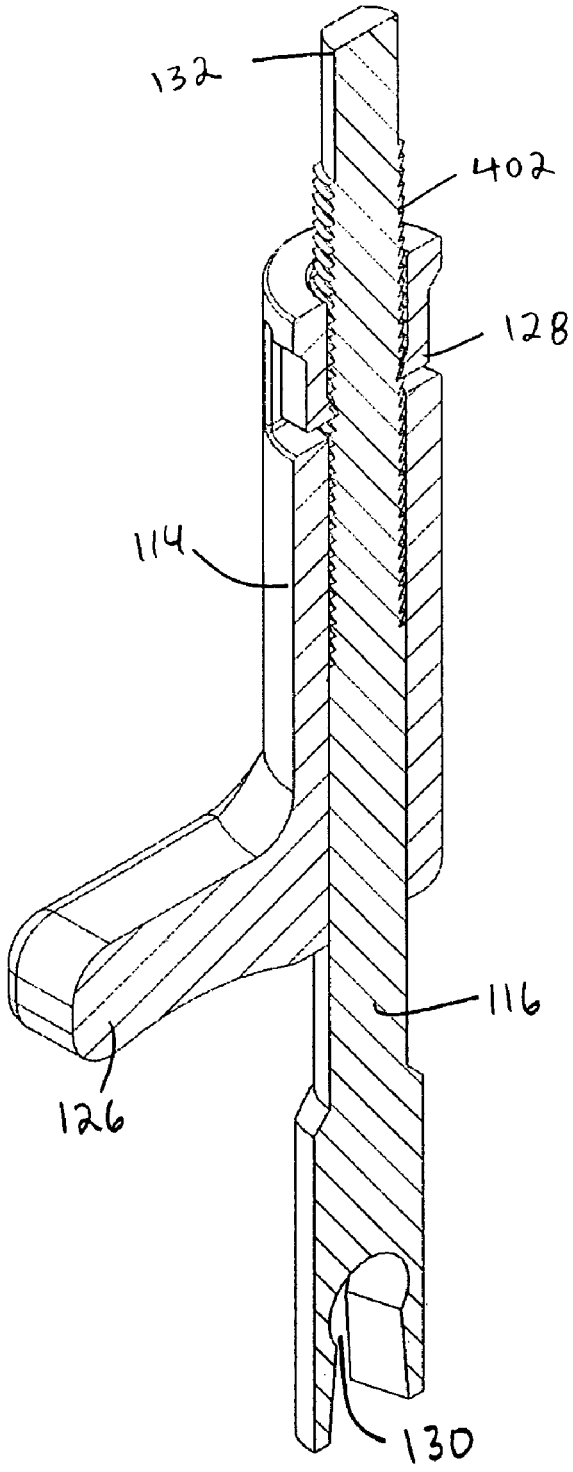
FIGS. 8-10 illustrate various views of the dog ratchet fastener in a secured position according to one embodiment of the invention.
Figure 9:
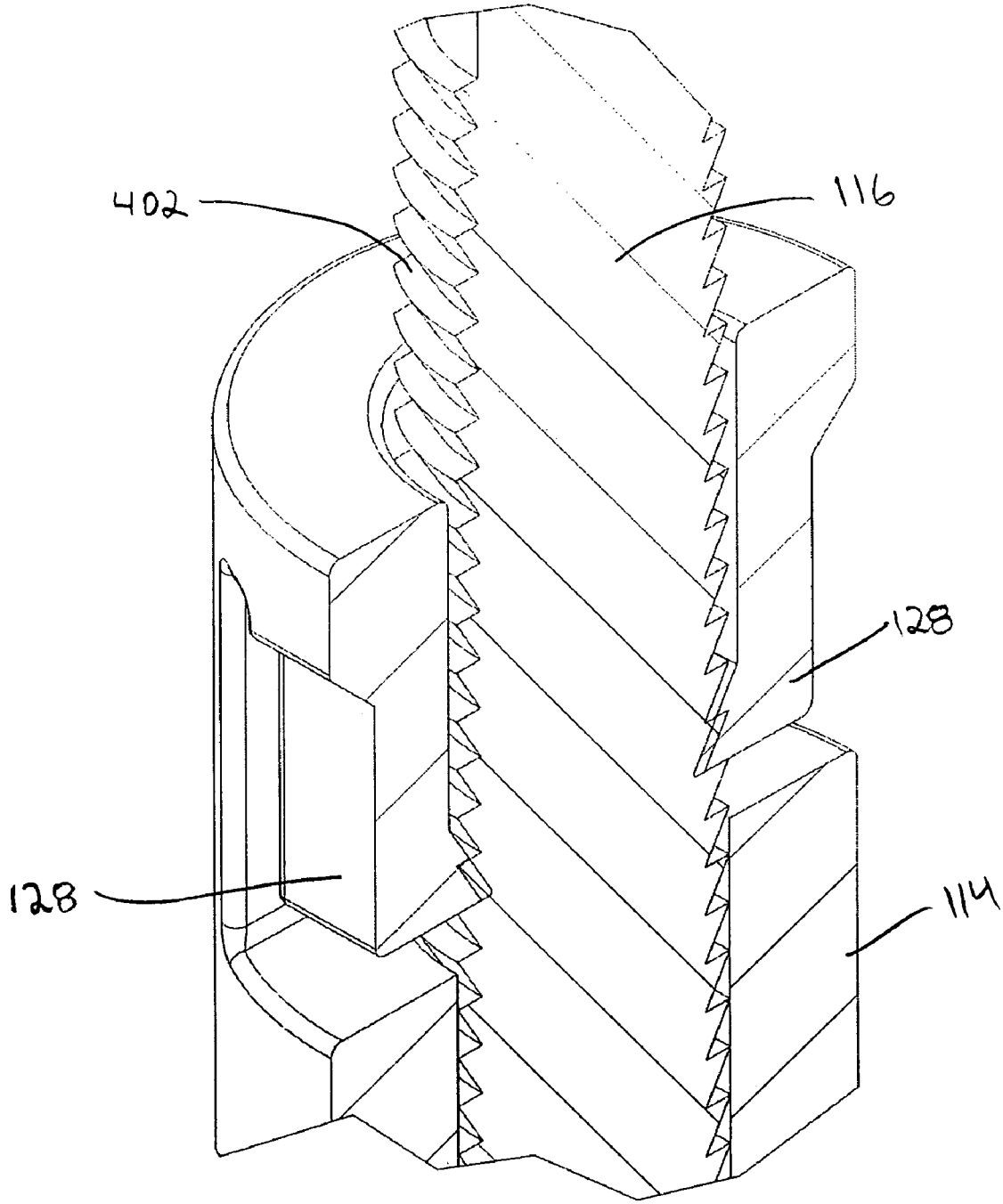
Figure 10:
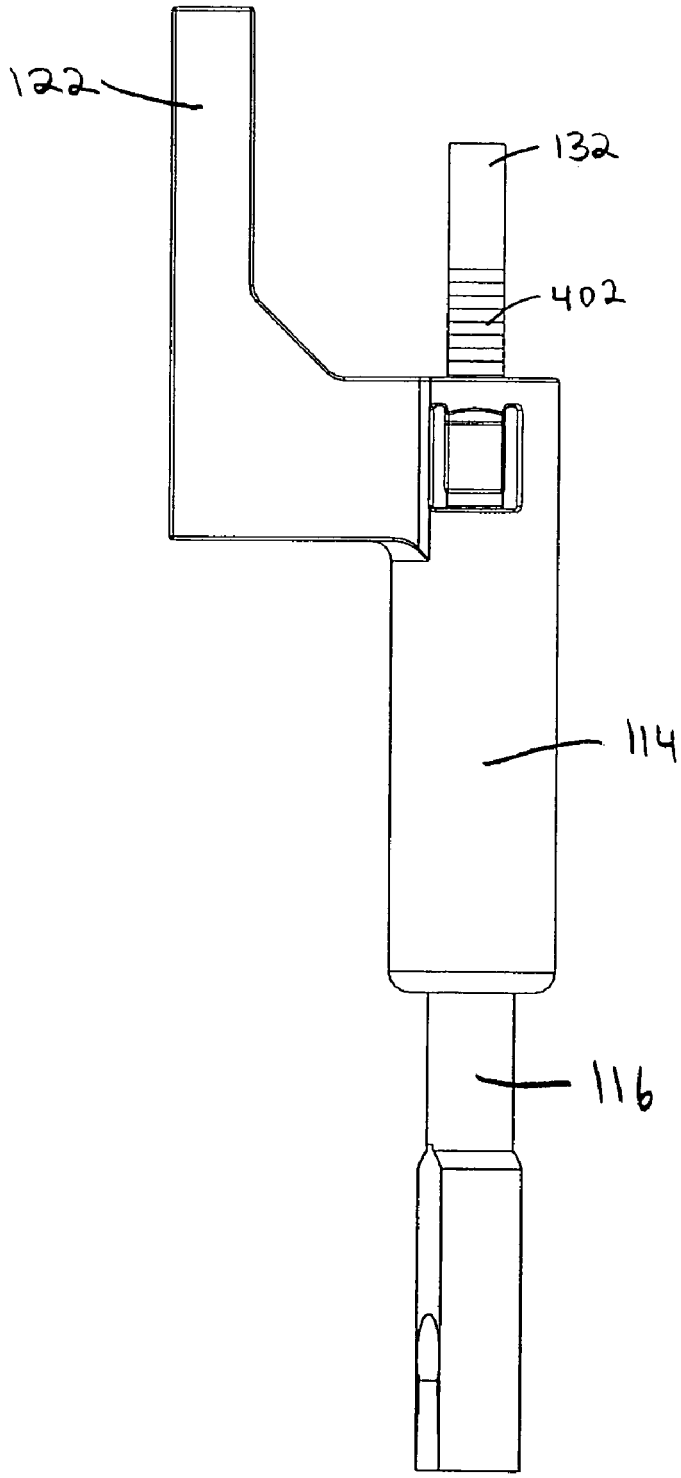

FIGS. 8-10 illustrate various views of the ratchet fastener 114 in an engaged position according to one embodiment of the invention. When the frame assembly 100 is inserted into a wall or ceiling opening and secured, the ratcheting retainer 114 is rotated so that the one or more pins or fingers 128 flexibly engage the teeth along the first longitudinal portion 402 of the ratchet post 116. When the ratcheting fastener 114 is slid toward the border flange 108, the orientation of the teeth along the first longitudinal portion 402 (illustrated in FIG. 9) permits pins 128 and the ratcheting fastener 114 to slide down the post 116, toward the first end 132, but not in the opposite direction. That is, the ratchet post 116 features a ratcheted section 402 (first longitudinal portion) with teeth inclined in one direction (as shown in FIG. 9) such that the retaining fastener 114 moves in only one direction (i.e., toward post end 132). This causes the frame assembly 100 to be secured by the border flange 108, which presses against a first surface of the sheetrock, and the ratcheting fastener 114, which presses against an opposite second surface of the sheetrock or drywall.

Figure 11:
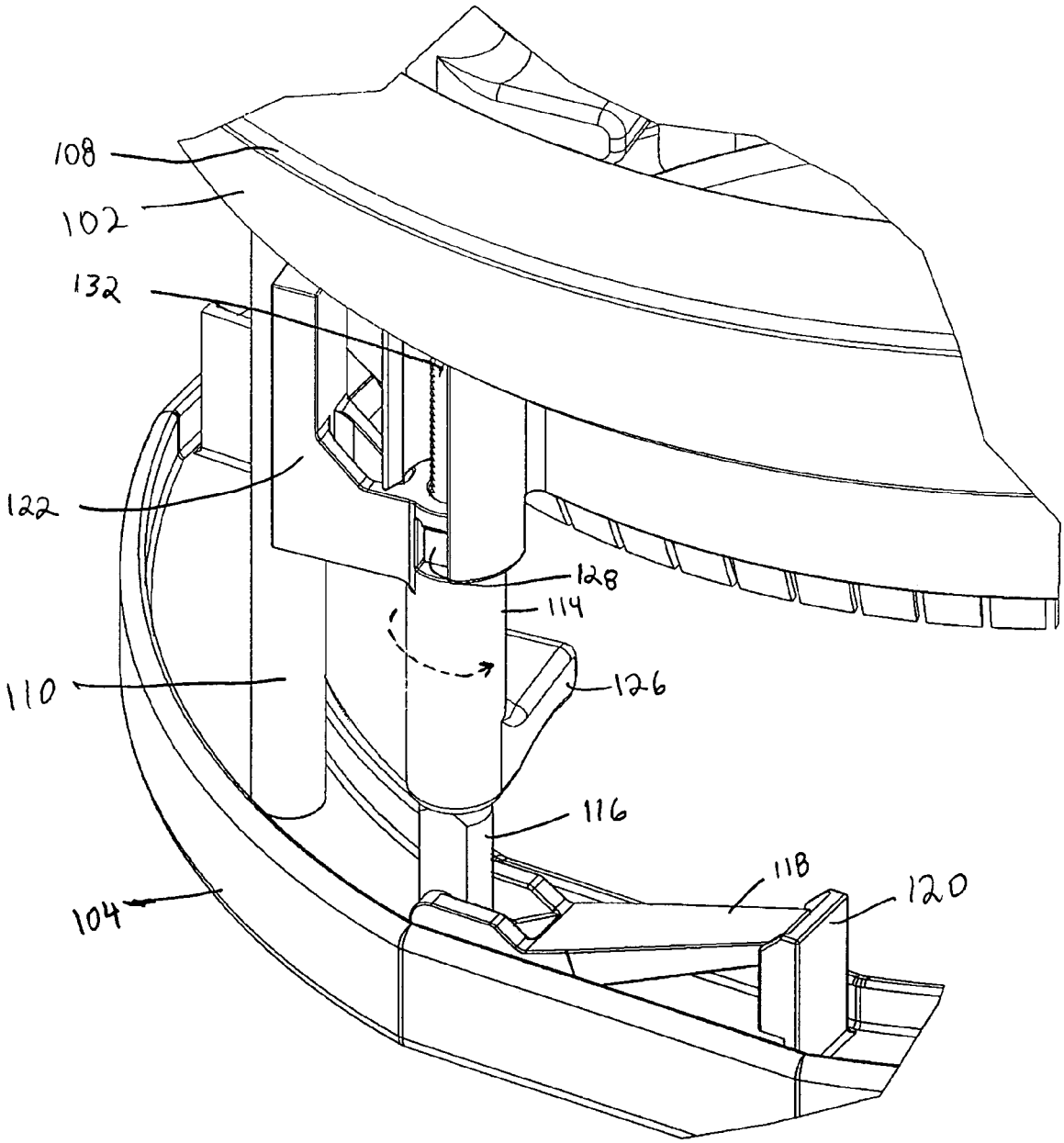
FIGS. 11-12 illustrate the rotation of the ratcheting retainer from a first position to a second position according to one embodiment of the invention.
Figure 12:
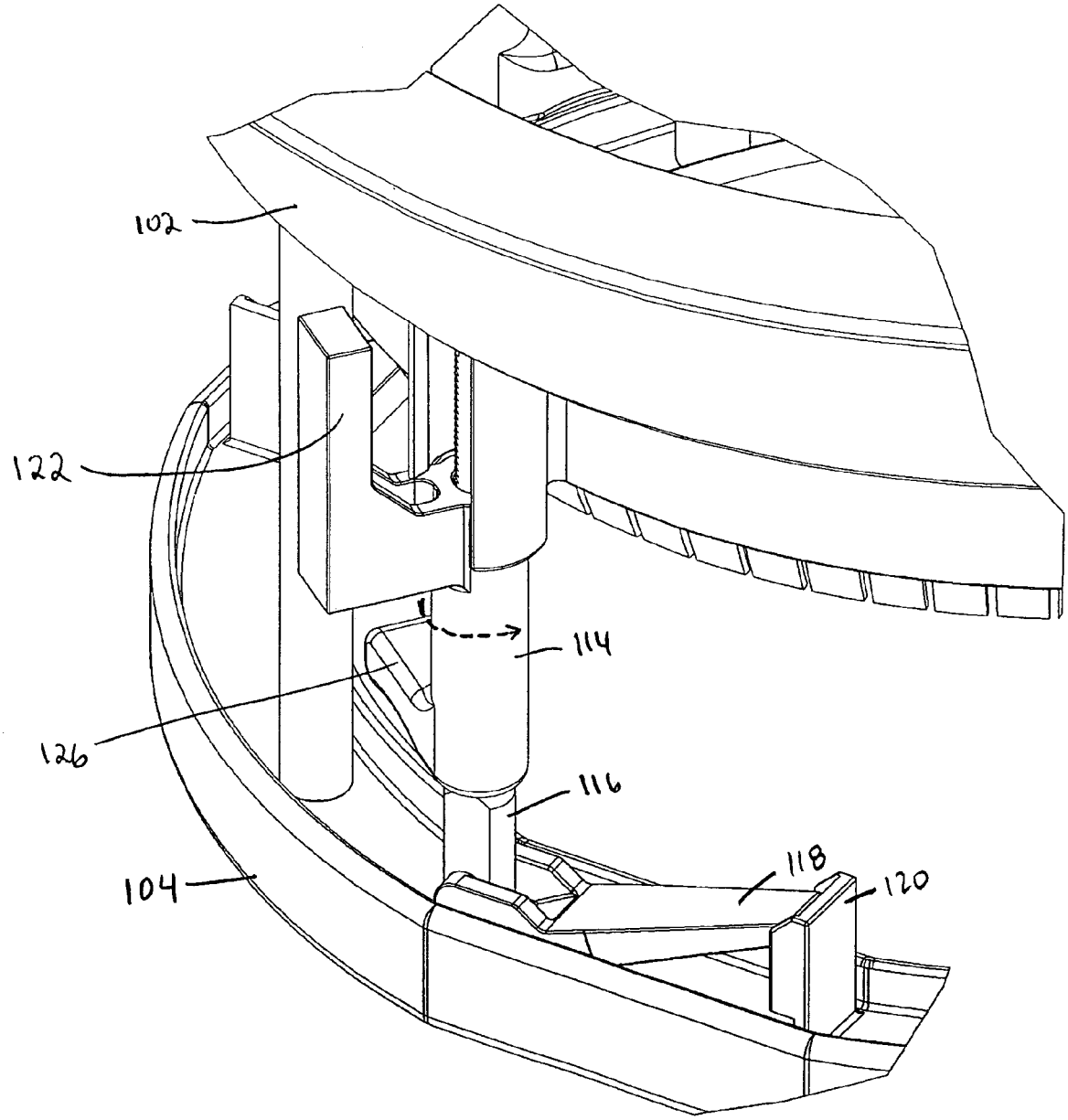

FIGS. 11-12 illustrate the rotation of the ratcheting retainer 114 from a first position to a second position according to one embodiment of the invention. In the first position, illustrated in FIG. 11, the ratcheting retainer 114 does not obstruct the insertion of the frame assembly 100 into an opening in the wall or ceiling. In this first position, the ratcheting retainer 114 is in the disengaged position relative to the ratchet post 116, as shown in FIGS. 5-7. In such implementation, the ratchet post 116 and latch 118 are positioned and secured such that the pins or fingers 128 rest along the second longitudinal portion 404 of the post 116 (as shown in FIG. 5-6), which is substantially smooth and without teeth.

Figure 13:
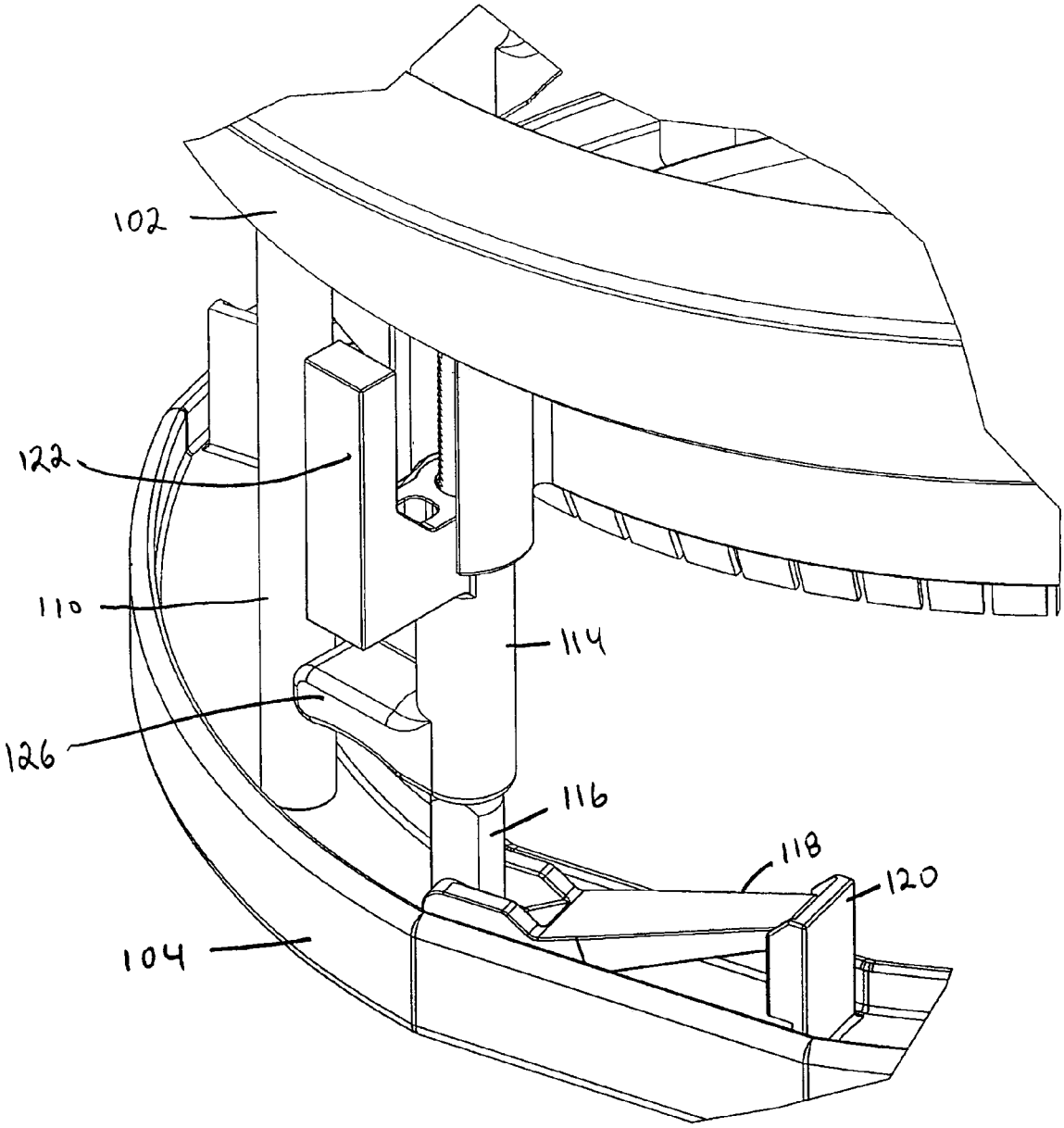
FIGS. 13-15 illustrate how a ratcheting retainer is slid to secure a frame assembly within a wall or ceiling cavity according to one embodiment of the invention.

Once inside the opening, an installer may rotate the ratcheting retainer 114, by reaching through the opening 106 and rotating the adjusting arm 126 to a second position, illustrated in FIG. 13. When the ratcheting retainer 114 is rotated for securing the frame assembly 100, the pins or fingers 128 engage the teeth along the first longitudinal portion 402 of the post 116 (as shown in FIG. 8-9). In the second position, the ratcheting retainer 114 is in an engaged position relative to the ratchet post 116, as illustrated in FIGS. 8-10, where the ratchet retainer pins or fingers 128 are engaged with the ratchet post teeth 402.

Figure 14:
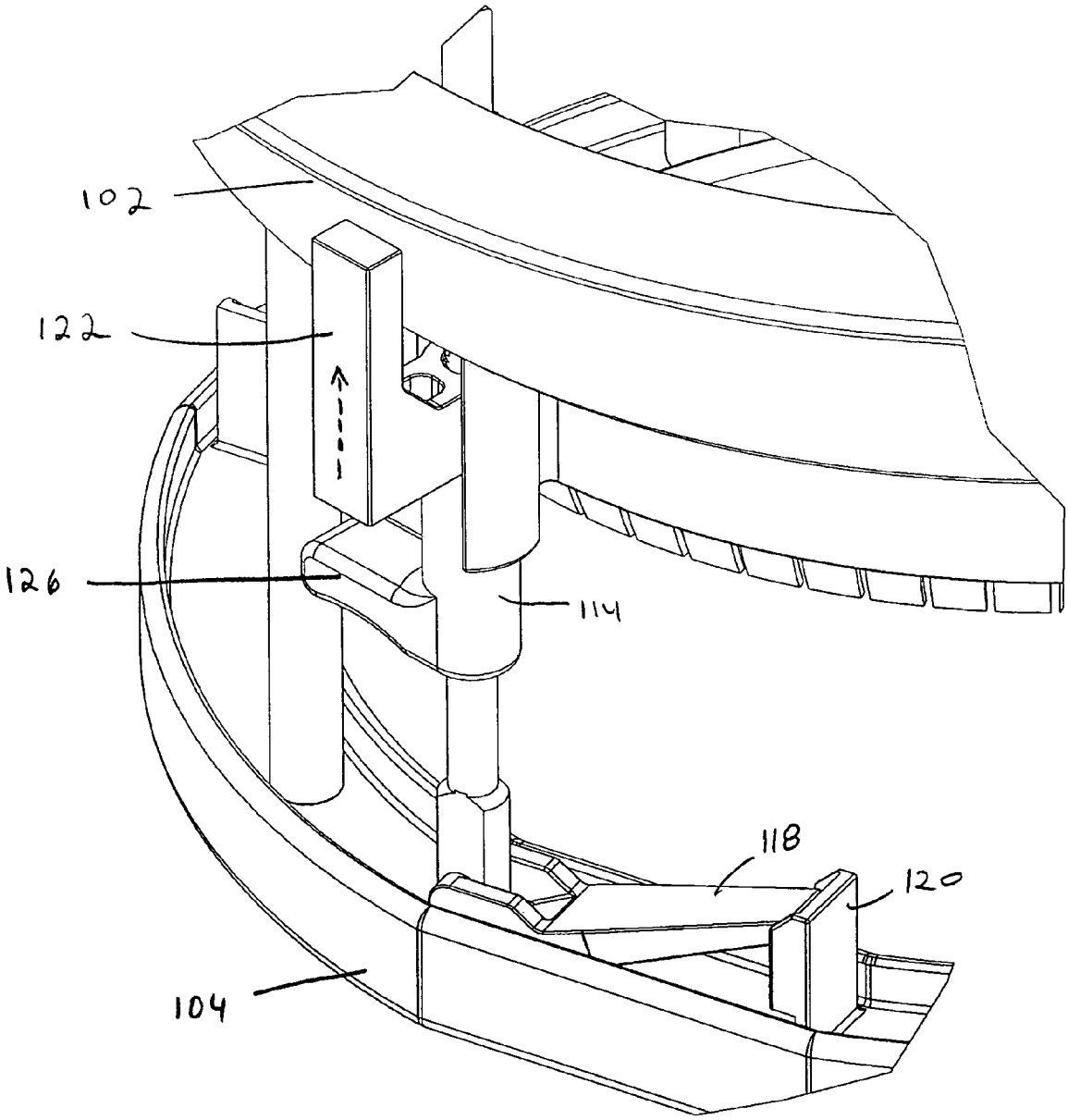

From the second position illustrated in FIG. 13, the ratcheting retainer 114 maybe be pushed toward the border flange 108 to secure the frame assembly 100 against the sheetrock or board defining the mount opening as illustrated in FIG. 14.

Figure 15:
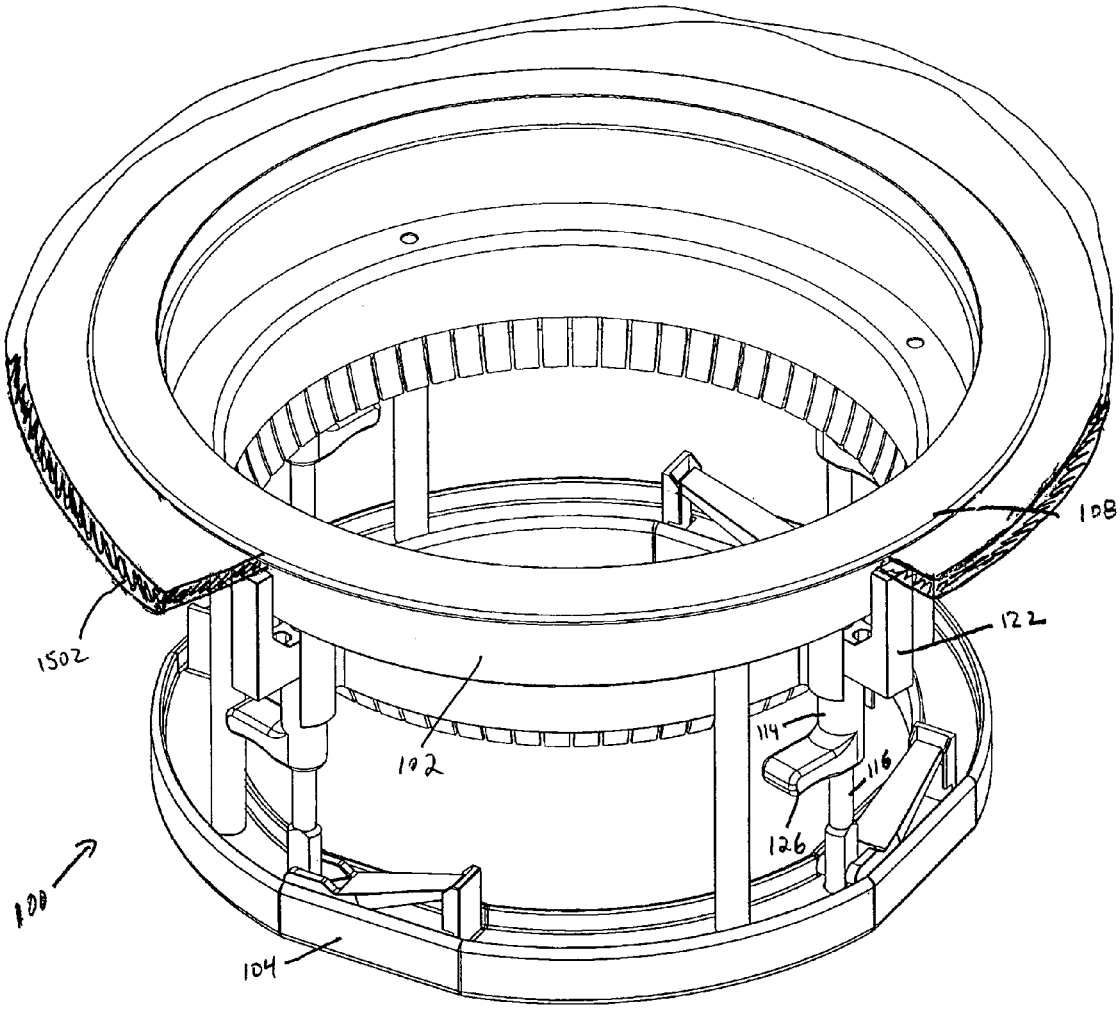

FIG. 15 illustrates an installed frame assembly 100 according to one implementation of the invention, four rotating, finger actuated, ratcheting fasteners 114 are rotated approximately ninety (90) degrees around the central axis of their corresponding ratcheting retainer 114 passing through sleeve 124 and then slid up along the ratchet post 116 to secure the frame assembly 100 in place against a sheetrock or board 1502 sandwiched between the ratcheting retainer 114 and the boarder flange 108.

Figure 16:
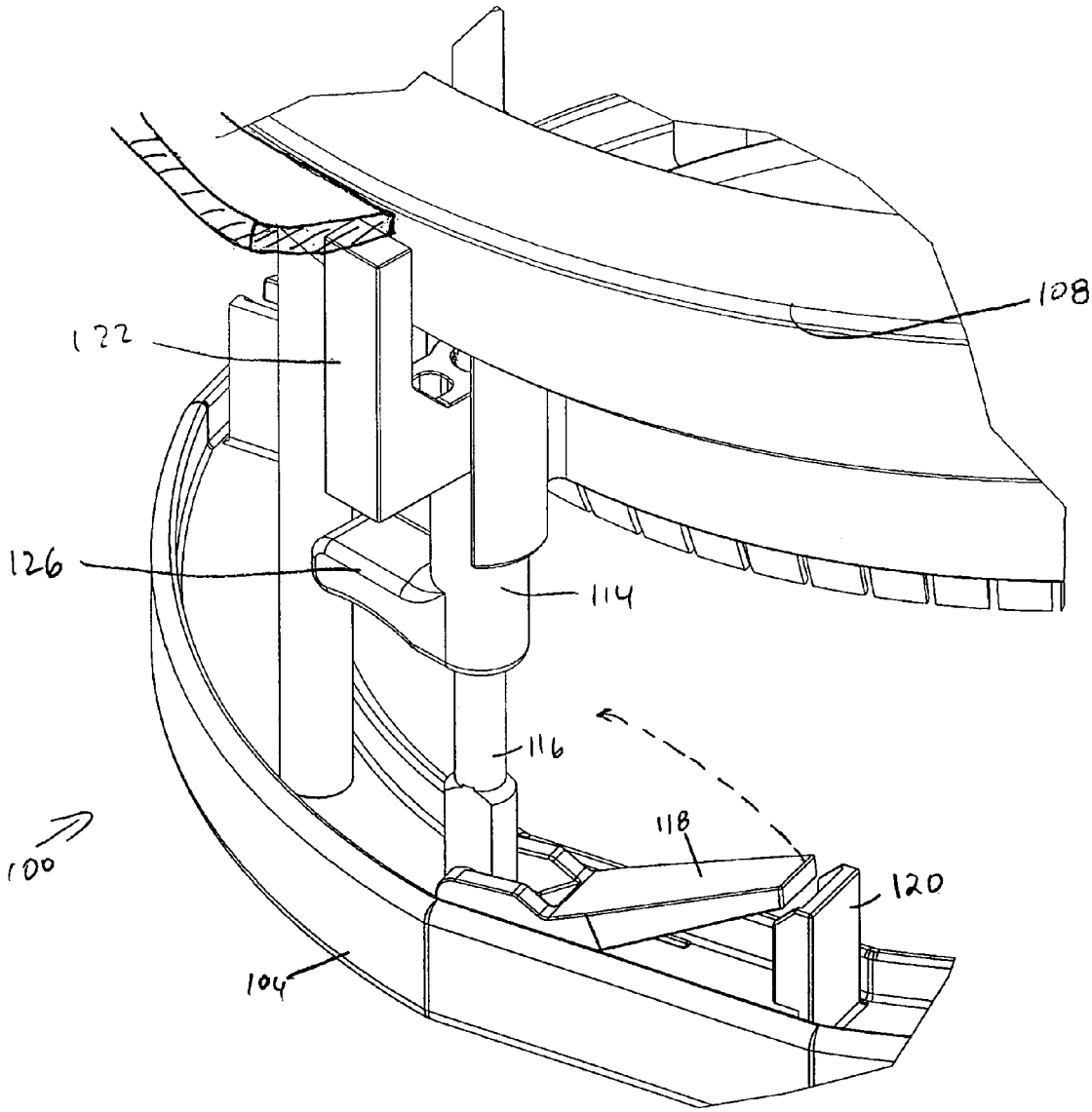
FIGS. 16-18 illustrate how an installed frame assembly may be disengaged from a wall or ceiling cavity according to one embodiment of the invention.
Figure 17:
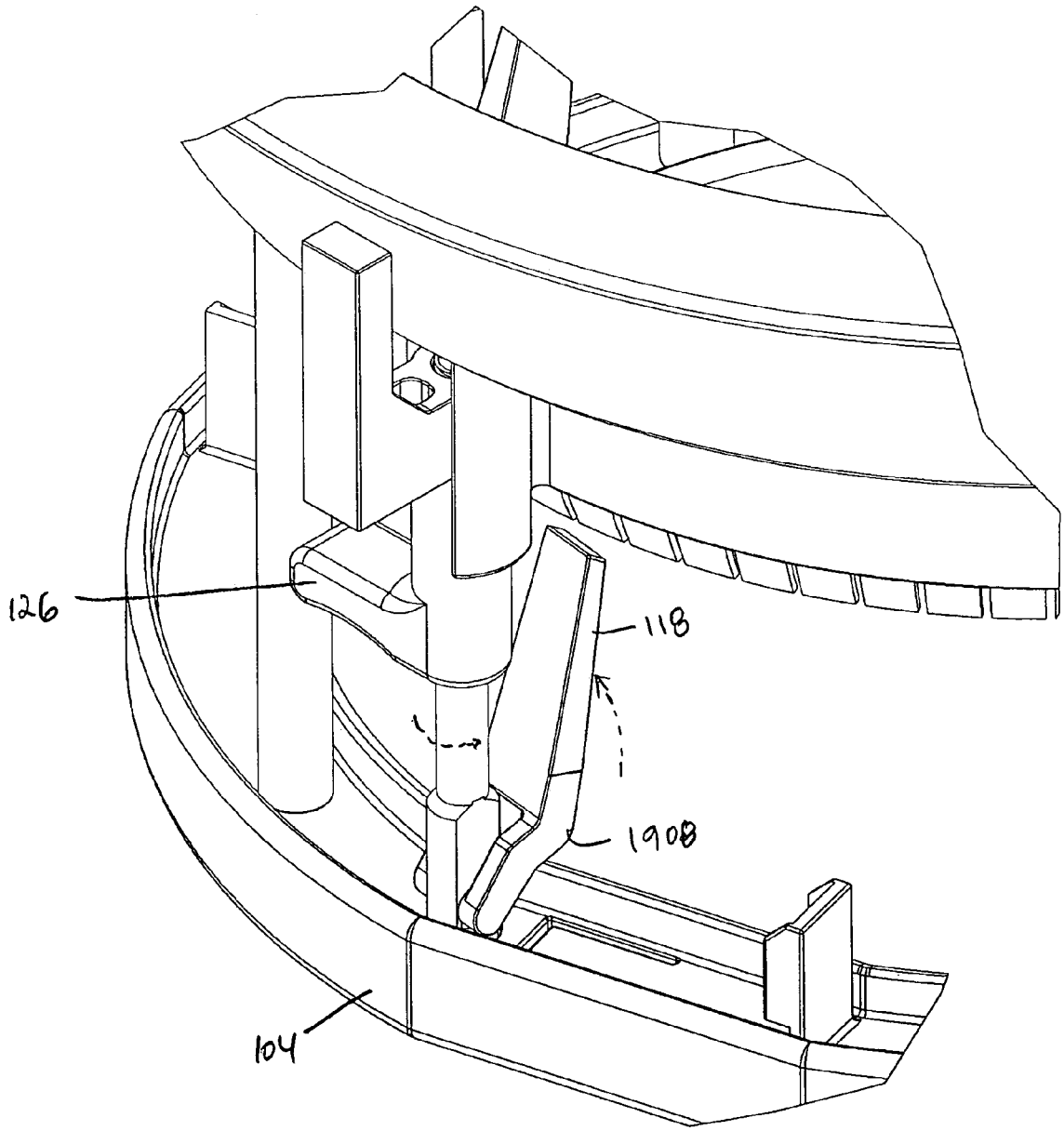
Figure 18:
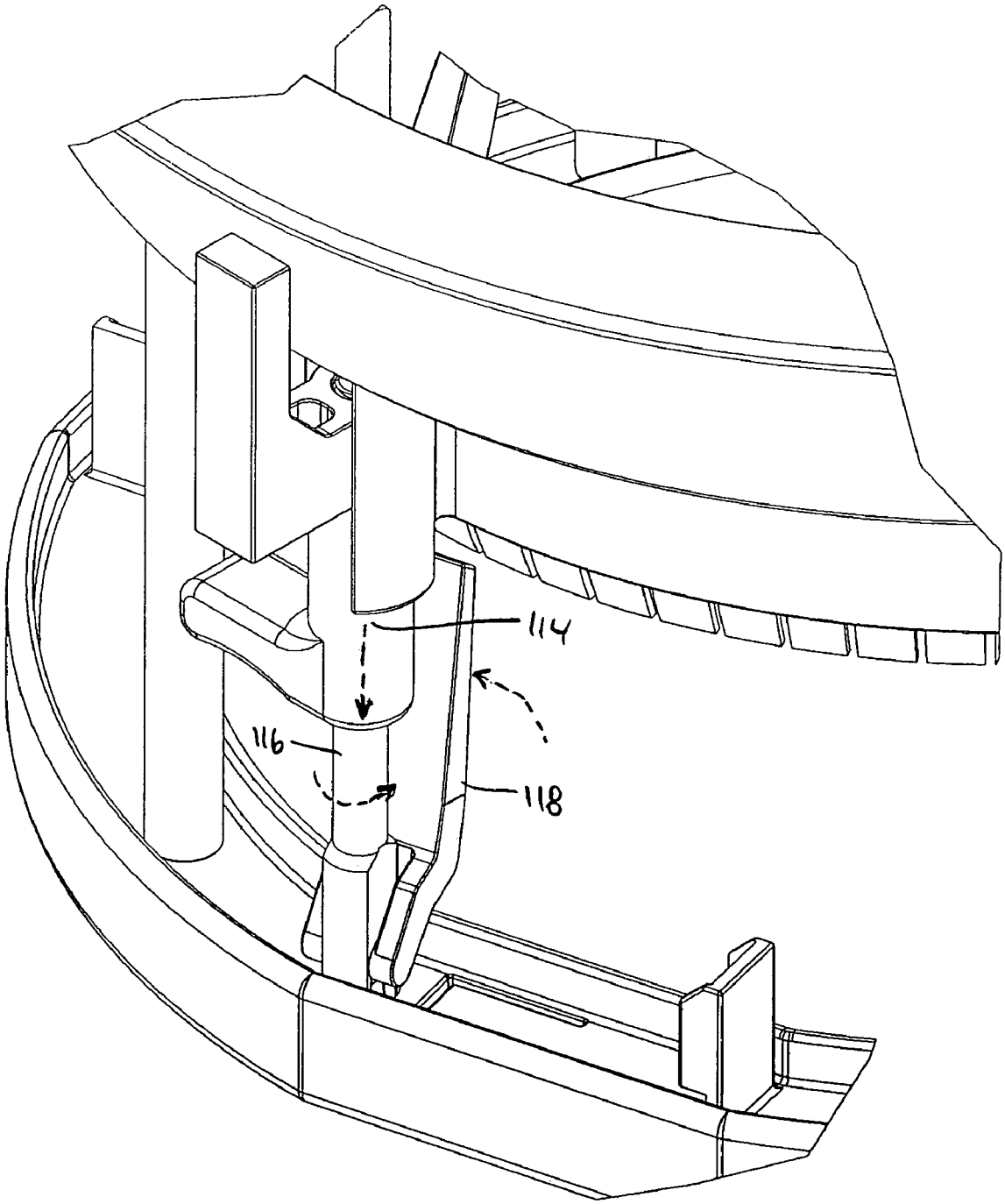

FIGS. 16-18 illustrate how an installed frame assembly 100 may be disengaged from a wall or ceiling cavity according to one embodiment of the invention. A previously installed frame assembly 100 may be removed from the wall or ceiling cavity by reaching through the center opening 106, disengaging the latch 118 from the latch receiver 120, lifting the latch 118 (as shown in FIG. 16), and rotating the latch 118 approximately ninety (90) degrees (as shown in FIGS. 17 and 18). The rotation of the latch 118 also causes the ratchet post 116 to rotate with the latch 118 and relative to the ratchet retainer 114. At the position illustrated in FIG. 18, the ratchet post 114 has been rotated so that it is disengaged from the ratchet retainer 114 as illustrated in FIGS. 5-7. In this position, the ratchet retainer pins or fingers 128 are disengaged with the ratchet post teeth 402 and rest against the smooth portion 404 of the ratchet post 116. The ratchet retainer 114 may then be pulled down the ratchet post 116, away from the border flange 108 to disengage the frame assembly 100. This facilitates the removal of the frame assembly 100 from the wall or ceiling without damaging the ratchet fastener 114, ratchet pins 128, or the ratchet post teeth 402. The ratchet retainer 114 can thus be retracted (i.e., slide towards the second end 130 of post 116) to release the frame assembly 100.

Once the ratchet retainer pins 128 are disengaged from the post teeth 402, the ratchet retainer 114 is retracted toward the second end 130 of the ratchet post 116. The ratcheting retainer 114 may then be rotated, approximately ninety (90) degrees, to move the retaining arm 122 out of the way (to the position illustrated in FIG. 11) and permit removal of the frame assembly 100.

Figure 19:
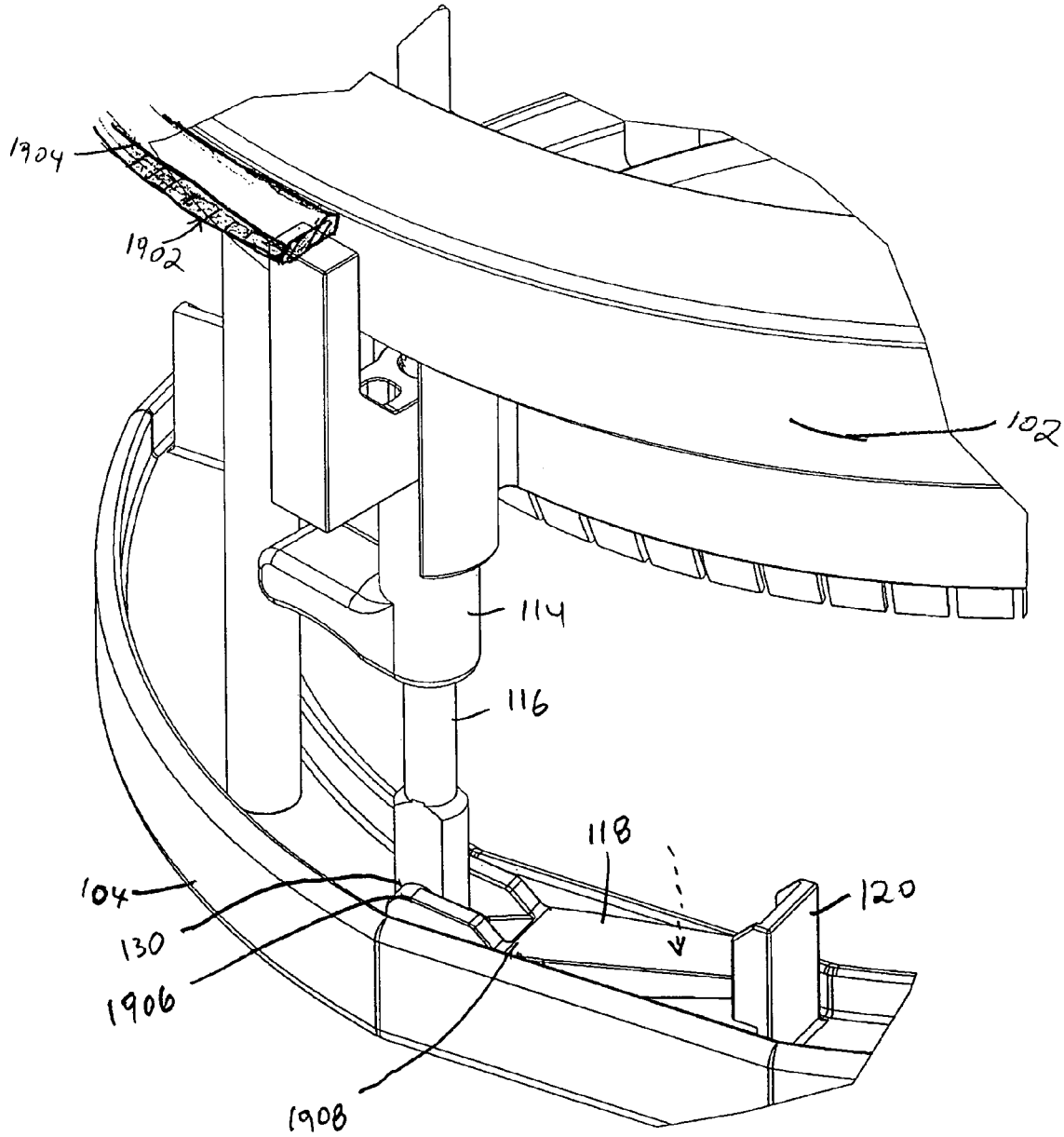
FIG. 19 illustrates another aspect of the invention in which a secondary tightening means further secures the frame assembly to the wall or ceiling.

FIG. 19 illustrates another aspect of the invention in which a secondary tightening means further secures the frame assembly 100 to the wall or ceiling. In some instances, because of the spacing of the ratchet post teeth 402, some play may be present when the ratcheting fastener 114 is in the secured position against the second surface 1902 of the wall or ceiling 1904. Some small additional tightening may be necessary to fully secure the frame assembly 100 to the wall or ceiling 1904. In one embodiment of the invention the latch 118 can be pushed into the latch receiver 120 to cause the ratchet post 116 to be pressed slightly toward the primary frame 102. The latch 118 includes a lever point 1908, which presses against the retainer frame 104 to cause the first end 1906 of the latch 118 to push on the second end 130 of the ratchet post 116. This causes the ratchet post 116 to move towards the primary frame 102, thus overcoming the any variation presented by the pitch (or spacing) of the ratchet post teeth 402. The second end 1910 of the latch 118 is then secured against the receiving latch 120. The receiving latch 120 includes one or more stops that help retain the second end 1910 of the latch 118. The latch 118 may be released from the receiving latch 120 by flexing the receiving latch 120 away from the latch 118.

Figure 20:
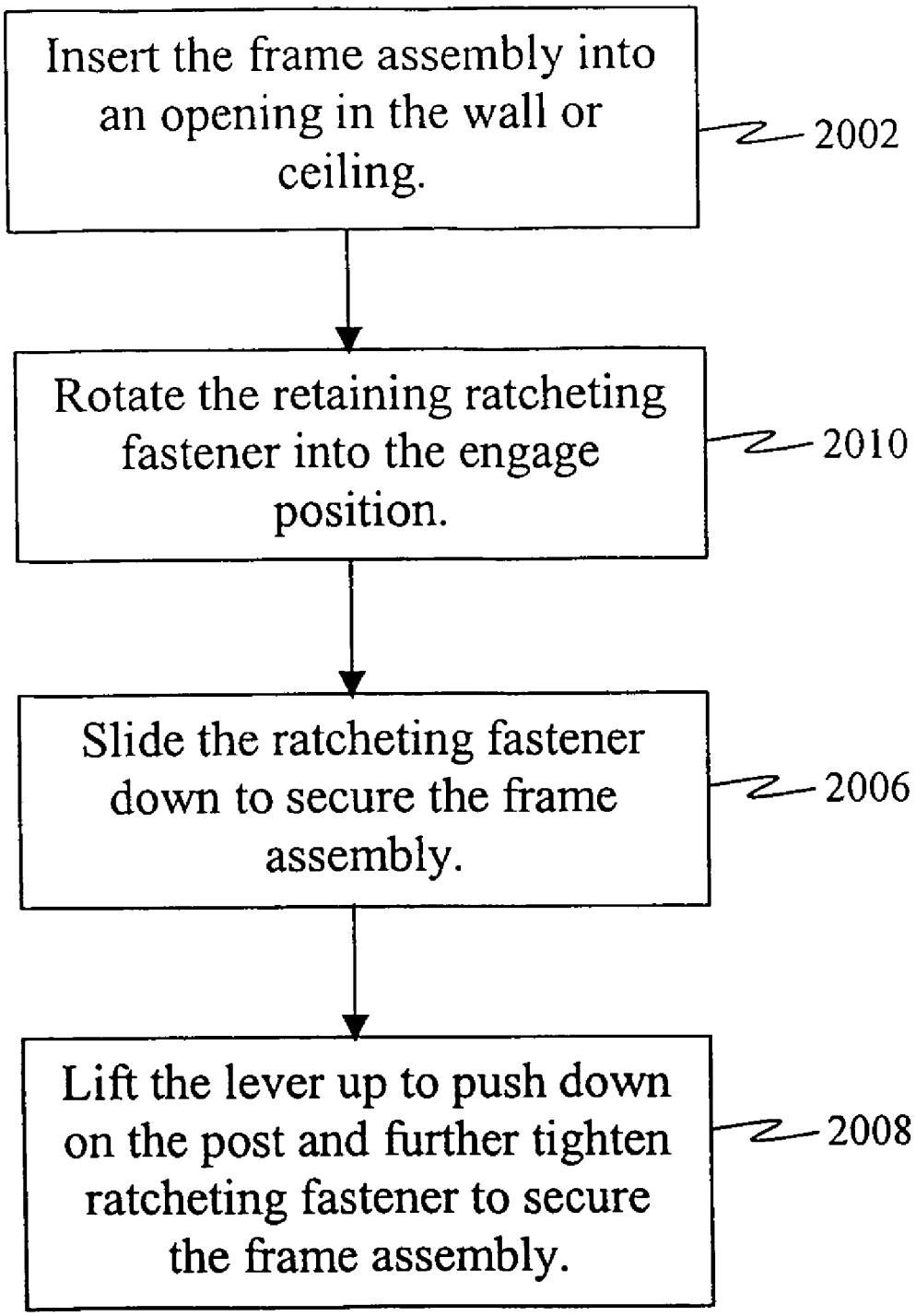
FIG. 20 is a diagram illustrating a method of mounting and securing a frame assembly within a wall or ceiling cavity according to one implementation of the invention.

FIG. 20 is a diagram illustrating a method of mounting and securing a frame assembly within a wall or ceiling cavity according to one implementation of the invention. Once an opening large enough to receive the frame assembly is made in the ceiling or wall, the frame assembly is inserted in the opening 2002. The installer may reach through the center of the frame assembly to rotate the ratcheting fastener 2004. The ratcheting fastener is then slid down to secure the frame assembly 2006. If necessary, the lever coupled to the second end of the post may lifted to tighten the ratcheting fastener bit more 2008.

Figure 21:
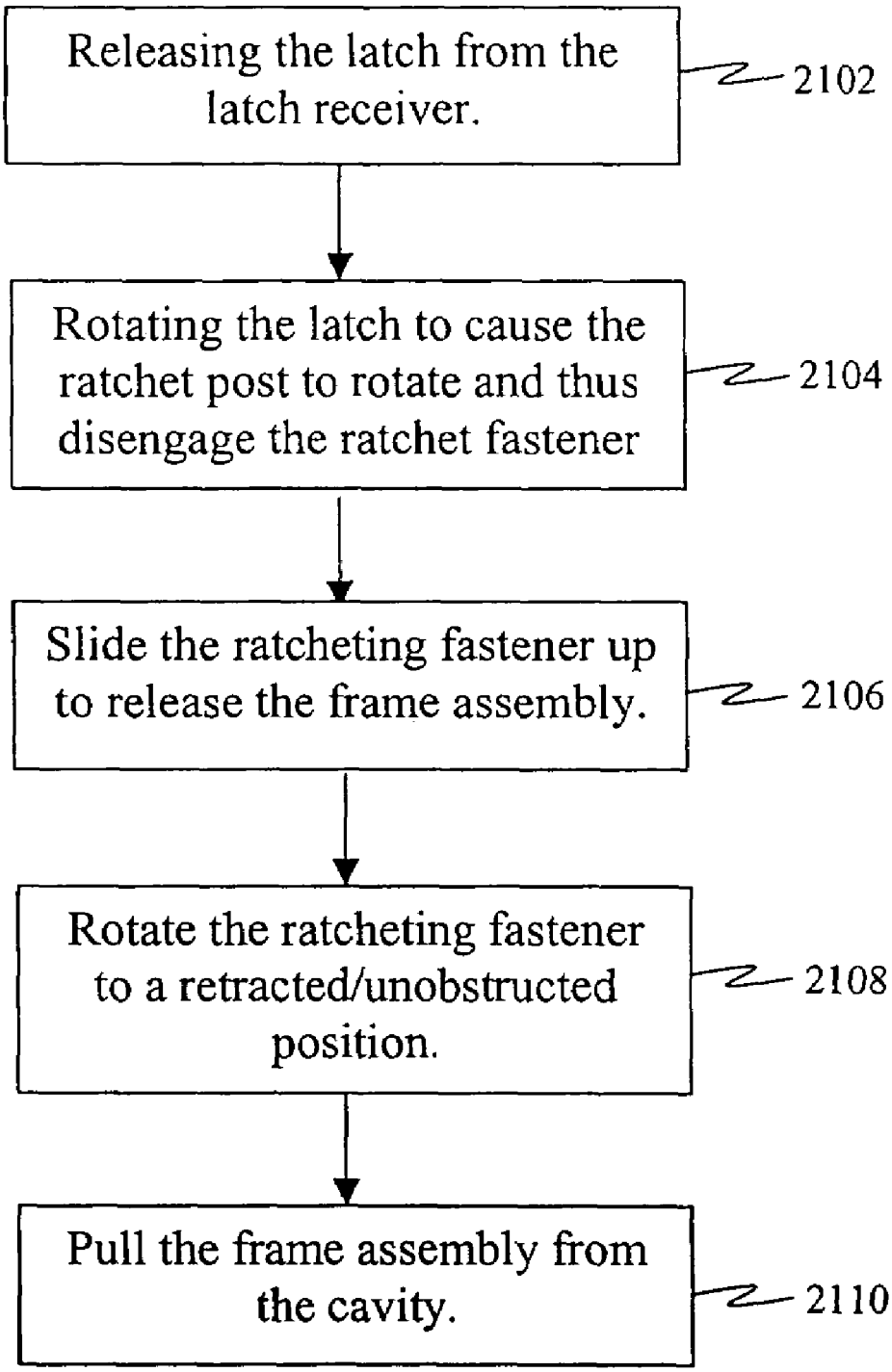
FIG. 21 is a diagram illustrating a method of removing a frame assembly from within a wall or ceiling cavity according to one implementation of the invention.

FIG. 21 is a diagram illustrating a method of removing a frame assembly from within a wall or ceiling cavity according to one implementation of the invention. The latch is released from the latch receiver 2102 to permit rotating the latch and post and thus disengage the ratchet fastener 2104. The ratcheting fastener is then slid to release the frame assembly 2106. The ratcheting fastener may then be rotated to a retracted or unobstructed position 2108 so that the frame assembly may be removed from the opening 2110.

Figure 22:
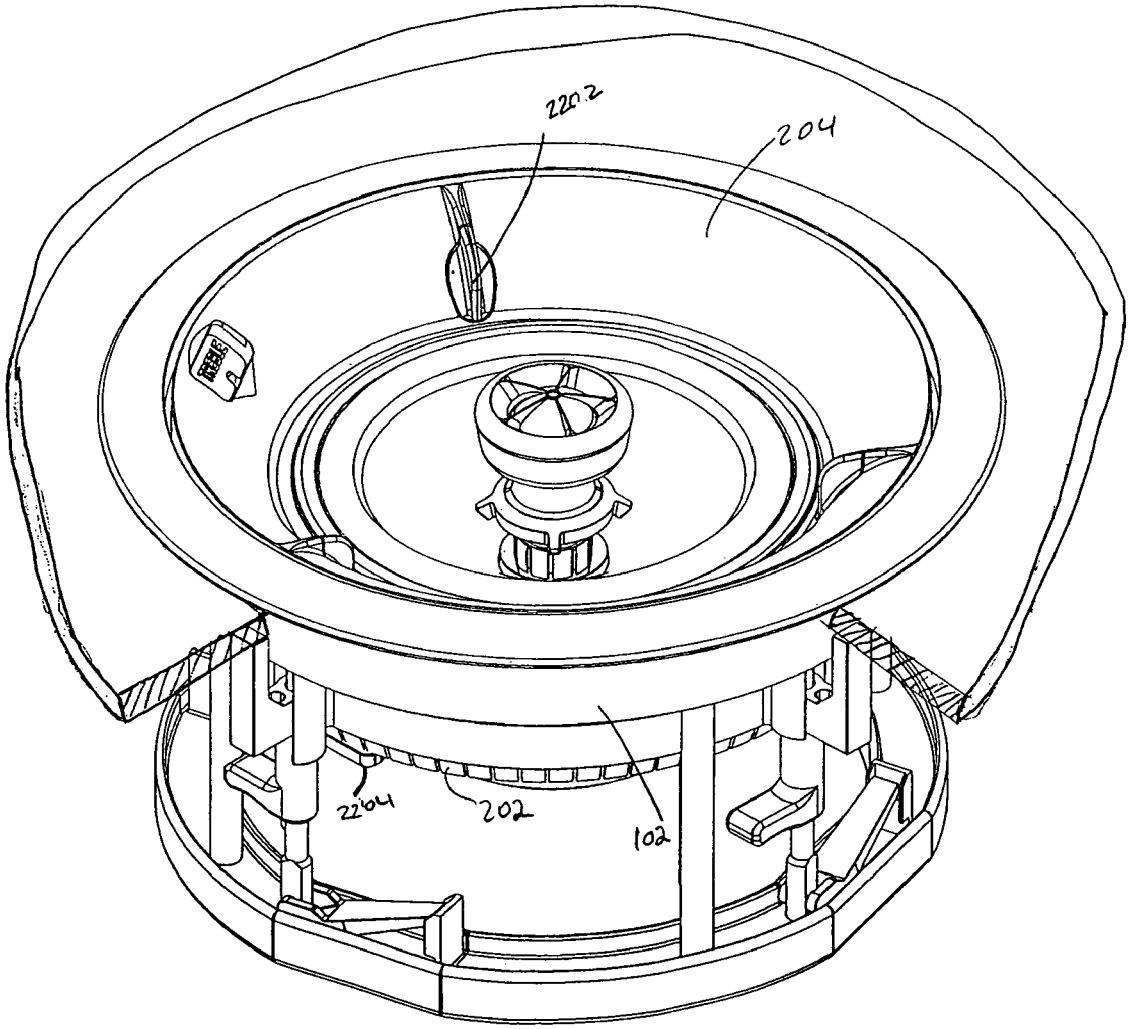
FIG. 22 illustrates how a speaker housing may be mounted within an installed frame assembly according to one embodiment of the invention.

FIG. 22 illustrates how a speaker housing may be mounted within a mounting frame assembly according to one embodiment of the invention. The speaker housing 204 is configured to fit snug through the frame assembly opening 106. The upper retaining fingers 202 flex back as the speaker housing 204 reaches that point. Retainers 2202 and 1004 in the speaker housing 204 may be rotated to slide over the fingers 202 and secure the speaker housing 204 in place.

According to one embodiment of the invention, the speaker housing 204 includes a baffle and manually engaging fasteners that couple the speaker housing 204 to the mounting frame assembly 102. Even when the fasteners 2202 secure the speaker housing 204 to the mounting frame assembly 102, the speaker housing 204 can freely rotate three hundred and sixty degrees as fastener footings 1004 slide over the retaining fingers 202.

Various embodiments of the invention may be implemented using parts, fasteners, frames, baffles, etc., constructed from one or more materials, or combination of material, including plastic, metal, polymers, and/or any other material.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A speaker mounting assembly comprising:

a primary mounting frame for recessed installation, the primary mounting frame defining an open interior to accommodate a fixture, the primary mounting frame including a border flange along the outer edge of the open interior;

a ratcheting fastener rotationally coupled to the primary mounting frame, the ratcheting fastener tightened by manually depressing it toward the border flange to secure the primary mounting frame between opposite surfaces of a substrate; and a retaining frame coupled to the primary mounting frame at an opposite end than the border flange, the retaining frame to retain the ratcheting fastener between the primary mounting frame and the retaining frame.

2. The speaker mounting assembly of claim 1 wherein the ratcheting fastener includes a ratchet post, the ratchet post including a first longitudinal portion that has a plurality of substantially parallel, non-helical teeth, a second longitudinal portion that is substantially smooth, a retainer, the retainer including a sleeve defining a passage through which the ratchet post passes, one or more fingers flexibly protruding into the passage through which the ratchet post passes, wherein the one or more fingers engage the substantially parallel teeth on the first longitudinal portion of the ratchet post when the ratchet post is in a first position, and slides over the substantially smooth portion on the second longitudinal portion of the ratchet post when the ratchet post is in a second position.

3. The speaker mounting assembly of claim 2 wherein the ratcheting fastener is released by rotating the retainer to disengage the one or more fingers from the teeth on the first longitudinal portion of the ratchet post.

4. The speaker mounting assembly of claim 2 wherein the ratcheting fastener is released by rotating the ratchet post to disengage the teeth on the first longitudinal portion from the one or more fingers on the retainer.

5. The speaker mounting assembly of claim 1 wherein the ratcheting fastener is released by manually rotating the ratcheting fastener and sliding it away from the border flange to release the primary mounting frame.

6. The speaker mounting assembly of claim 1 further comprising:

a lever pivotally coupled to the ratcheting fastener, the lever to prevent the rotation of the ratcheting fastener in a first position, and rotate the ratchet post in a second position.

7. The speaker mounting assembly of claim 6 wherein a third position the lever pushes down on the ratchet fastener to further tighten the ratcheting fastener.

8. The speaker mounting assembly of claim 6, wherein the ratcheting fastener includes:

a ratchet post; and a retainer.

9. The speaker mounting assembly of claim 8 wherein a first end of the lever pushes down on the ratchet post to cause the retainer to tighten the retainer against the substrate.

10. The speaker mounting assembly of claim 9 wherein a second end of the lever is moved towards the retaining frame to cause the first end of the lever to push down on the ratchet post.

11. The speaker mounting assembly of claim 10 wherein the retaining frame includes a lever retainer that holds the second end of the lever to keep the first end of the lever pushing down on the ratchet post.

12. The speaker mounting assembly of claim 8 wherein the ratchet post includes a first longitudinal portion having a plurality of parallel, non-helical teeth along a length of the ratchet post that, in a first position of the retainer, engage the retainer to prevent the retainer from sliding on the ratchet post toward the retaining frame, and a second longitudinal portion having a substantially smooth portion that, in a second position of the retainer, allows the retainer to move freely along the length of the ratchet post.

13. A speaker mounting assembly comprising:

a primary mounting frame for recessed installation, the primary mounting frame defining an open interior to accommodate a fixture;

a ratcheting fastener coupled to the primary mounting frame, the ratcheting fastener including a first longitudinal portion that has a plurality of substantially parallel teeth and a second longitudinal portion that is substantially smooth, the ratcheting fastener tightened by longitudinally depressing it to secure the primary mounting frame between opposite surfaces of a substrate;

a lever pivotally coupled to the ratcheting fastener, the lever to prevent the rotation of the ratcheting fastener in a first position, and rotate the ratcheting fastener in a second position; and a retaining frame coupled to the primary mounting frame, the retaining frame to retain the ratcheting fastener between the primary mounting frame and the retaining frame.

14. The speaker mounting assembly of claim 13 wherein a third position the lever pushes down on the ratcheting fastener to further tighten the ratcheting fastener.

15. The speaker mounting assembly of claim 13 further comprising:

a retainer including a sleeve defining a passage through which the ratcheting fastener passes, one or more fingers flexibly protruding into the passage through which the ratcheting fastener passes, wherein the one or more fingers engage the substantially parallel teeth on the first longitudinal portion of the ratcheting fastener when it is in a first position, and slides over the substantially smooth portion on the second longitudinal portion of the ratcheting fastener when it is in a second position.

16. A speaker mounting assembly comprising:

a primary mounting frame for accommodating a fixture for recessed installation;

a ratcheting fastener coupled to the primary mounting frame for securing the primary mounting frame between opposite surfaces of a substrate; and a lever pivotally coupled to the ratcheting fastener, the lever adapted to prevent the rotation of the ratcheting fastener in a first position, rotate the ratcheting fastener in a second position, and push down on the ratcheting fastener to further tighten the ratcheting fastener against the substrate in a third position.

17. The speaker mounting assembly of claim 16 further comprising:

a retaining frame coupled to the primary mounting frame, the retaining frame to retain the ratcheting fastener between the primary mounting frame and the retaining frame.

18. The speaker mounting assembly of claim 16 wherein the ratcheting fastener includes a first longitudinal portion that has a plurality of substantially parallel teeth and a second longitudinal portion that is substantially smooth, the first and second longitudinal portions co-linear with each other.

* * * * *